US006375800B1

(12) United States Patent
Steiner et al.

(10) Patent No.: US 6,375,800 B1
(45) Date of Patent: Apr. 23, 2002

(54) PRESS SECTION AND PROCESS

(75) Inventors: Karl Steiner, Herbrechtingen; Gerhard Kotitschke, Steinheim; Thomas Augscheller, Bachhagel, all of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/548,679

(22) Filed: Apr. 13, 2000

(30) Foreign Application Priority Data

Apr. 27, 1999 (DE) ..... 199 19 051

(51) Int. Cl.[7] ..... D21F 3/04
(52) U.S. Cl. ..... 162/193; 162/205; 162/360.2
(58) Field of Search ..... 162/203, 205, 162/206, 210, 193, 306, 305, 358.1, 358.3, 358.5, 359.1, 360.2, 360.3, 361

(56) References Cited

U.S. PATENT DOCUMENTS

| | | | | | |
|---|---|---|---|---|---|
| 3,826,713 | A | * | 7/1974 | Nykopp | 162/205 |
| 4,075,056 | A | * | 2/1978 | Ely et al. | 162/305 |
| 4,257,844 | A | * | 3/1981 | Schmitt et al. | 162/305 |
| 4,915,790 | A | * | 4/1990 | Dahl | 162/305 |
| 5,238,535 | A | * | 8/1993 | Kraft | 162/193 |
| 5,308,450 | A | * | 5/1994 | Braun et al. | 162/360.2 |
| 5,744,006 | A | * | 4/1998 | Mausser et al. | 162/358.1 |
| 5,762,761 | A | * | 6/1998 | Kivimaa et al. | 162/360.2 |
| 5,820,731 | A | * | 10/1998 | Soderholm | 162/203 |
| 6,090,244 | A | | 7/2000 | Kotitschke | 162/306 |
| 6,136,149 | A | * | 10/2000 | Vallius | 162/199 |
| 6,214,618 | B1 | * | 4/2001 | Puustinen et al. | 162/205 |

FOREIGN PATENT DOCUMENTS

| | | | |
|---|---|---|---|
| DE | 4443875 | 6/1996 | D21F/3/02 |
| DE | 29701382 | 4/1997 | D21F/3/10 |
| DE | 29800330 | 6/1998 | D21F/3/00 |
| DE | 19708967 | 9/1998 | F26B/13/08 |
| DE | 19802054 | 7/1999 | D21F/3/02 |

* cited by examiner

*Primary Examiner*—Peter Chin
*Assistant Examiner*—Eric Hug
(74) *Attorney, Agent, or Firm*—Greenblum & Bernstein, P.L.C.

(57) ABSTRACT

Press section of a machine and process for producing a fiber web. The press section includes at least two press nips arranged in succession in a web travel direction. Each of the at least two press nips is formed by two press rolls. At least one continuously revolving press belt is guided around each press roll. At least one of before and after at least one of the at least two press nips, a guide region is formed in which two of the press belts are arranged to run jointly along a straight path, and the fiber web is adapted to run between the two press belts along the straight path. Guide elements are arranged at an end of each guide region. At an end of each guide region, the press belts are guided over the guide elements to run separately from one another, and a press belt angle between the press belts at the guide elements is greater than approximately 15°. The process includes successively pressing the fiber web in the at least two press nips, and jointly guiding the fiber web between two of the press belts in the at least one guide region. The at least one guide region includes a substantially straight path. The process also includes separating the two press belts at the guide element at the end of the at least one guide region at a separation angle of at least 15°.

40 Claims, 1 Drawing Sheet

PRESS SECTION AND PROCESS

CROSS-REFERENCE TO RELATED APPLICATIONS

The present application claims priority under 35 U.S.C. §119 of German Patent Application No. 199 19 051.8, filed on Apr. 27, 1999, the disclosure of which is expressly incorporated by reference herein in its entirety.

BACKGROUND OF THE INVENTION

1. Field of the Invention

The invention relates to a press section of a machine and process for producing a fiber web, in particular a paper, cardboard, or tissue web, having at least two press nips lying in succession in the web travel direction and each formed by two press rolls, with at least one separate, continuously revolving press belt being conducted around each press roll and, before and/or after at least one press nip, the fiber web running jointly with two press belts on opposite sides along a straight path in a guide region.

2. Discussion of Background Information

Such arrangements are generally known and are described, for example, in DE-OS 197 08 967. In these arrangements, turbulent air flows, in particular at high speeds, can cause the press felts to flutter, having an adverse effect on the quality of the paper as well as on the life of the press felts. Furthermore, the cross currents of air that likewise occur result in damage to the edge of the fiber web.

SUMMARY OF THE INVENTION

It is therefore the object of the invention to create a press section, while avoiding these disadvantages.

The object was achieved according to the invention in that, at the end of each guide region on the opposite side of the press nip, the press belts run separately from one another over guide elements such that the press belt angle between the press belts is greater than approximately 15°.

The bilateral guidance of the fiber web in the guide region is secure and stable even at high speeds and prevents damage to the fiber web. The relatively large press belt angle is necessary in this arrangement in order to reduce air turbulences and air flows oriented transverse to the fiber web in the entrance or exit twist of the press belts.

In order to guarantee a secure guidance of the fiber web even outside a guide region, the fiber web should be in constant contact with one of the press belts. It is advantageous in this situation for all the press belts to be formed as press felts or press screens to absorb the pressed water. It is also possible, in particular when the fiber web has a high dry content, to embody one of the two press belts of a press nip as a smooth press belt with little or no water-absorbing capacity.

A guide region of a certain length, which should preferably be greater than approximately 0.5 m, is a prerequisite for a particularly calm running of the press belts.

Since rotatable guide rolls are usually used as the guide elements of the press belts, the radius of these guide rolls influences the degree of air flow. In order to bring the press belts together or apart rapidly, the radius of the guide rolls should therefore be as small as possible, preferably less than approximately 0.8 m.

For adapting to changing operating conditions or different types of fiber webs, or for introducing the fiber web into the press section, it is advantageous for at least one guide element to be mounted in a movable fashion, so that the press belt angle can be changed by the position of a guide element. In order to be able to keep the tension of the press belt concerned relatively stable, this guide element should be movable perpendicular to the angle bisector of the looping angle of the respective press belt.

Such a secure guidance is provided if a guide region is present before and after each press nip.

However, it is also possible for the two press belts of a press nip to run separately before and/or after the press nip, with the press belt angle between the press belts being greater than 15°. This enables relatively compact arrangements. To reduce the air flows, however, all the press belt angles between the press belts should be greater than approximately 15° and preferably greater than approximately 30°.

When the press belts run toward one another, the press belt not in contact with the fiber web should have air devices to remove the air boundary layer on the side facing the fiber web, which devices are preferably formed as a doctor, a compressed air nozzle, or a suction roll.

The present invention is directed to a press section of a machine for producing a fiber web. The press section includes at least two press nips arranged in succession in a web travel direction. Each of the at least two press nips is formed by two press rolls. At least one continuously revolving press belt is guided around each press roll. At least one of before and after at least one of the at least two press nips, a guide region is formed in which two of the press belts are arranged to run jointly along a straight path, and the fiber web is adapted to run between the two press belts along the straight path. Guide elements are arranged at an end of each guide region. At an end of each guide region, the press belts are guided over the guide elements to run separately from one another, and a press belt angle between the press belts at the guide elements is greater than approximately 15°.

According to a feature of the instant invention, the fiber web can include one of a paper, cardboard, or tissue web.

In accordance with another feature of the invention, the fiber web can be supported in a region of the press section by at least one press belt.

According to still another feature of the present invention, all the press belts can include press felts.

Further, the guide elements can include rotatable guide rolls having a radius smaller than approximately 0.8 m.

Moreover, at least one of the guide elements can be positionally movably mounted. In this manner, moving a position of the at least one guide element adjusts the press belt angle. The at least one guide element is movable substantially perpendicular to an angle bisector of a looping angle of a respective press belt around the at least one guide element.

In accordance with an aspect of the invention, guide regions can be arranged before and after each of the at least two press nips.

According to another aspect of the invention, the two press belts of at least one of the at least two press nips can be arranged to run separately at least one of before and after the at least one press nip, and a press belt angle between the two press belts of the at least one press nip can be greater than approximately 15°.

Further, all press belt angles between the press belts may be greater than 15°. Moreover, at least some of the press belt angles may be greater than approximately 30°.

The press section can also include air devices. The air devices may be arranged to remove an air boundary layer from a side of one of the press belts adapted to face the fiber web before the side makes contact with the fiber web. The air devices can include at least one of a doctor, a compressed air nozzle, and a suction roll.

In accordance with a further aspect of the invention, all guide regions can be longer than approximately 0.5 m.

According to still another aspect of the invention, the at least two press nips are extended in the web travel direction.

The instant invention is directed to a press section of a machine for manufacturing a fiber web. The press section includes a first press having a first and second press roll arranged to form a first nip, and a second press having a third and fourth press roll arranged to form a second nip. The first and second presses are successively arranged in a web travel direction. At least four press belts are provided. A first press belt is guided around the first press roll, a second press belt is guided around a second press roll, a third press belt is guided around the third press roll, and a fourth press belt is guided around the fourth press roll. A web guide region is arranged at least one of before and after at least one of the first and second nips. The web guide region includes a substantially straight path along which two of the at least four press belts are arranged to run jointly. At an end of the web guide region, the two press belt are arranged to separate at a belt angle greater than approximately 15°.

In accordance with a feature of the invention, at least one guide element may be positioned at an end of the web guide region, such that the two press belts separate at the at least one guide element. Further, at least one of the at least one guide element is a positionally movable guide element. Moving a position of the movable guide element adjusts the press belt angle. Still further, one of the two press belts can wrap around the movable element at a predetermined looping angle, and the movable element may be movable substantially perpendicularly to an angle bisector of the looping angle.

According to another feature of the invention, a web guide region can be arranged both before and after at least one of the first and second nips. Further, the web guide region may be arranged both before and after the first and second presses.

The first and second presses may be arranged to form first and second extended nips which are elongated in the web travel direction. At least one of the first and second press roll can be a shoe press roll, and at least one of the third and fourth press roll can be a shoe press roll.

According to a further feature of the present invention, the two press belts of at least one of the first and second press may be arranged to run separately at least one of entering and exiting a respective one of the at least one first and second nip, and a press belt angle between the two press belts at least one of entering and exiting the at least one first and second nip may be greater than approximately 15°.

In accordance with still another feature of the invention, a first separation angle formed by the separation of the first and second press belts can be greater than approximately 15°, and a second separation angle formed by the separation of the third and fourth press belts can be greater than approximately 15°. At least one of the first and second separation angle can be greater than approximately 30°. Further, the first and the second separation angles may be greater than approximately 30°.

The present invention is directed to a process of pressing a fiber web in a press section that includes at least two press nips, each of the at least two press nips being formed by two press rolls, at least one continuously revolving press belt being guided around each press roll, at least one guide region being formed at least one of before and after at least one of the two press nips, and guide elements arranged at an end of each guide region. The process includes successively pressing the fiber web in the at least two press nips, and jointly guiding the fiber web between two of the press belts in the at least one guide region. The at least one guide region includes a substantially straight path. The process also includes separating the two press belts at the guide element at the end of the at least one guide region at a separation angle of at least 15°.

According to a feature of the present invention, the process further includes guiding the fiber through one of the at least one guide regions which exits the second press nip in a web travel direction. The process can also include guiding the fiber web through another of the at least one guide regions which enters the second press nip, and guiding the fiber through another of the at least one guide regions which exits the first press nip in the web travel direction. The process can also include separating the fiber web from one of the press belts when exiting the first press nip in the web travel direction. A separation angle of the press belt exiting the first nip can be greater than 15°. Moreover, the process can include separating the press belts upon exiting the first press nip in the web travel direction.

In accordance with yet another feature of the instant invention, the at least one guide region can be located after the first press nip in the web travel direction, and the process can also include adjusting the separation angle at the end of the at least one guide region by moving the guide element. The guide element may be movable in a direction substantially perpendicular to an angle bisector of a looping angle of one of the press belts around the guide element.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

The invention is explained in greater detail below based on two examples. In the attached drawings.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
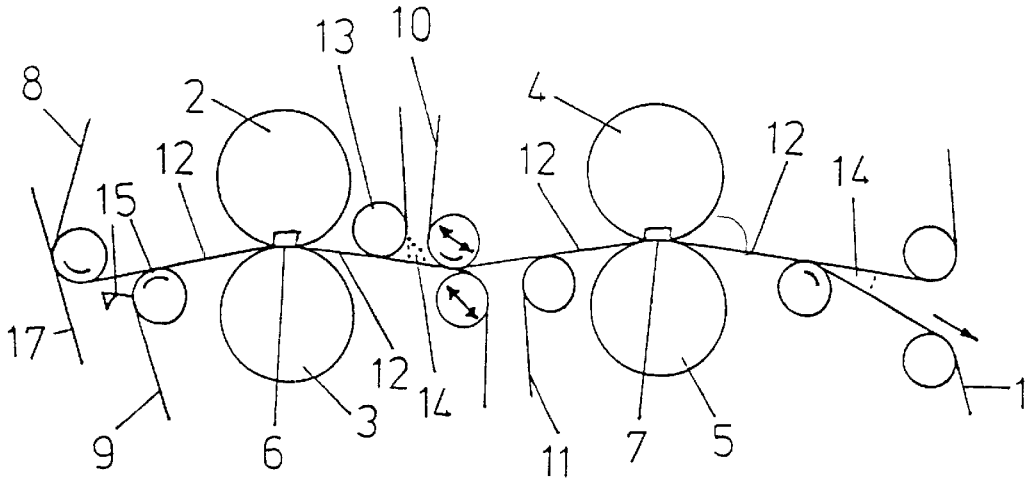
FIG. 1 shows a press section having guide regions 12 before and after all press nips 6, 7.
Figure 2:
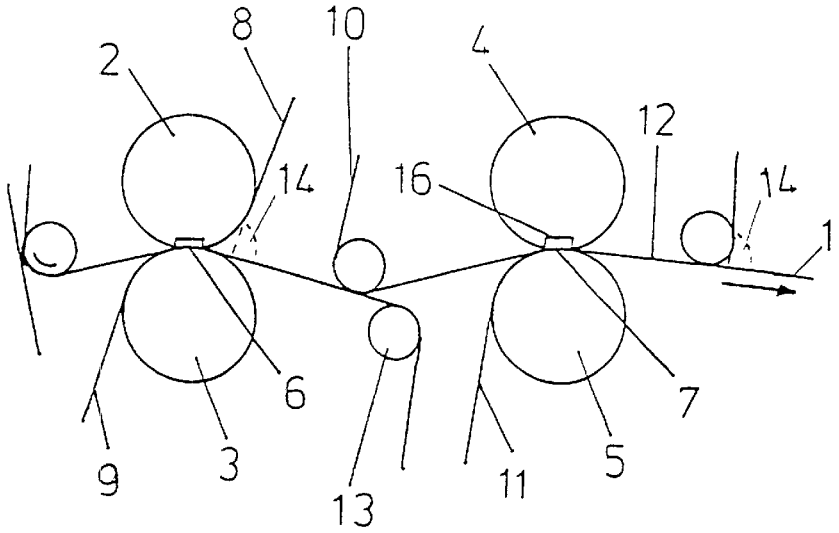
FIG. 2 shows a press section with only one press nip 7 having a guide region 12.

In FIGS. 1 and 2, the press section for draining a fiber web 1 includes two press nips 6, 7 lying in succession in the web travel direction and formed by two press rolls 2, 3, 4, 5 respectively pressed against one another. Each press roll 2, 3, 4, 5 has its own continuously circulating press belt 8, 9, 10, 11 in the form of a press felt for absorbing and carrying away the water pressed from the fiber web 1.

Before and/or after a press nip 6, 7, the fiber web 1 is thus conducted jointly with the two press felts of the press nip 6, 7 along a straight path in a guide region 12 that is longer than approximately 0.5 m. Moreover, it is essential here that, at the end of each guide region 12 on the opposite side of the press nip 6, 7, the press belts 8, 9, 10, 11 run separately from one another over guide elements 13 such that the press belt angle 14 between the press belts 8, 9, 10, 11 is greater than approximately 15°. In addition to a stable guidance in the guide region 12, the relatively large press belt angles 14 result in a minimization of the air flows and turbulences.

To guide the press belts 8, 9, 10, 11 forwards and/or away rapidly, the guide elements 13 are formed here as guide rolls whose radius is smaller than approximately 0.8 m. The guide rolls can also be constructed as suction rolls to assist the transfer of the fiber web 1.

Moreover, the fiber web 1 is supported in the region of the entire press section by at least one press felt, so that good guidance is guaranteed even at high speeds.

As shown in FIG. 1, some guide rolls are mounted so as to be movable perpendicular to the angle bisector of the looping angle of the applicable press belt 9, 10, for the purpose of varying the press belt angle 14 and adapting it to certain operating conditions or for introducing the fiber belt 1.

In both arrangements, the fiber web 1 is removed from a screen 17 of an upstream former. Moreover, the press nips 6, 7 are extended by the use of press rolls 2, 4, arranged above in this case, in the form of shoe press rolls. These shoe press rolls have a flexible roll sleeve that is pressed against the other press roll 3, 5 via a press shoe 16 with a concave pressing surface.

In FIG. 1, a guide region 12 is present before and after each press nip 6, 7. Furthermore, air devices 15 for removing the air boundary layer are assigned to the lower press belt 9 of the first press nip 6. The side of the press belt 9 facing the fiber web 1 has a doctor, while the guide element 13 is constructed as a suction roll.

In contrast, in FIG. 2, the press belts 8, 9 of the first press nip 6 run separately before and after this press nip 6, as do the press belts 10, 11 of the second press nip 7 before this press nip 7. The second press nip 7 is followed by a guide region 12.

In each case, the press belt angles 14 between the press belts 8, 9, 10, 11 are greater than approximately 15° and sometimes even greater than approximately 30° in order to minimize the air flows and turbulences.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A press section of a machine for producing a fiber web comprising:

at least two press nips arranged in succession in a web travel direction, wherein each of said at least two press nips is formed by two press rolls;

at least one continuously revolving press belt being guided around each press roll;

wherein, at least one of before and after at least one of said at least two press nips, a guide region is formed in which two of said press belts are arranged to run jointly along a straight path, and the fiber web is adapted to run between said two press belts along said straight path; and guide elements arranged at an end of each guide region, wherein at an end of each guide region, said press belts are guided over said guide elements to run separately from one another, and wherein a press belt angle between said press belts at said guide elements is greater than approximately 15°, wherein said guide elements comprise rotatable guide rolls having a radius smaller than approximately 0.8 m.

2. The press section in accordance with claim 1, wherein the fiber web comprises one of a paper, cardboard, or tissue web.

3. The press section in accordance with claim 1, wherein the fiber web is supported in a region of said press section by at least one press belt.

4. The press section in accordance with claim 1, wherein all the press belts comprise press felts.

5. The press section in accordance with claim 1, wherein at least one of said guide elements is positionally movably mounted.

6. The press section in accordance with claim 5, wherein moving a position of said at least one guide element adjusts said press belt angle.

7. The press section in accordance with claim 5, wherein said at least one guide element is movable substantially perpendicular to an angle bisector of a looping angle of a respective press belt around said at least one guide element.

8. The press section in accordance with claim 1, wherein a guide region is arranged before and after each of said at least two press nips.

9. The press section in accordance with claim 1, wherein said two press belts of at least one of said at least two press nips are arranged to run separately at least one of before and after said at least one press nip, and wherein a press belt angle between said two press belts of said at least one press nip is greater than approximately 15°.

10. The press section in accordance with claim 1, wherein all press belt angles between said press belts are greater than 15°.

11. The press section in accordance with claim 10, wherein at least some of said press belt angles are greater than approximately 30°.

12. The press section in accordance with claim 1, further comprising air devices, wherein said air devices are arranged to remove an air boundary layer from a side of one of said press belts adapted to face the fiber web before said side makes contact with the fiber web.

13. The press section in accordance with claim 12, wherein said air devices comprise at least one of a doctor, a compressed air nozzle, and a suction roll.

14. The press section in accordance with claim 1, wherein said at least two press nips are extended in the web travel direction.

15. A press section of a machine for producing a fiber web, comprising:

at least two press nips arranged in succession in a web travel direction, wherein each of said at least two press nips is formed by two press rolls;

at least one continuously revolving press belt being guided around each press roll;

wherein, at least one of before and after at least one of said at least two press nips, a guide region is formed in which two of said press belts are arranged to run jointly along a straight path, and the fiber web is adapted to run between said two press belts along said straight path; and guide elements arranged at an end of each guide region, wherein at an end of each guide region, said press belts are guided over said guide elements to run separately from one another, and wherein a press belt angle between said press belts at said guide elements is greater than approximately 15°, wherein all guide regions are longer than approximately 0.5 m.

16. The press section in accordance with claim 15, wherein said guide elements comprise rotatable guide rolls having a radius smaller than approximately 0.8 m, and wherein at least one of said guide elements is a movably mounted guide roll.

17. A press section of a machine for manufacturing a fiber web, comprising:

a first press comprising a first and second press roll arranged to form a first nip;

a second press comprising a third and fourth press roll arranged to form a second nip;

said first and second presses being successively arranged in a web travel direction;

at least four press belts, wherein a first press belt is guided around said first press roll, a second press belt is guided around a second press roll, a third press belt is guided around said third press roll, and a fourth press belt is guided around said fourth press roll;

a web guide region arranged at least one of before and after at least one of said first and second nips, said web guide region comprising a substantially straight path along which two of said at least four press belts are arranged to run jointly, wherein at an end of said web guide region, said two press belt are arranged to separate at a belt angle greater than approximately 15°, and wherein said web guide region is longer than approximately 0.5 m.

18. The press section in accordance with claim 17, further comprising at least one guide element positioned at an end of said web guide region, wherein said two press belts separate at said at least one guide element.

19. The press section in accordance with claim 18, wherein at least one of said at least one guide element is a positionally movable guide element.

20. The press section in accordance with claim 19, wherein moving a position of said movable guide element adjusts said press belt angle.

21. The press section in accordance with claim 19, wherein one of said two press belts wraps around said movable element at a predetermined looping angle, and wherein said movable element is movable substantially perpendicularly to an angle bisector of the looping angle.

22. The press section in accordance with claim 17, wherein a web guide region is arranged both before and after at least one of said first and second nips.

23. The press section in accordance with claim 22, wherein said web guide region is arranged both before and after said first and second presses.

24. The press section in accordance with claim 17, wherein said first and second presses are arranged to form first and second extended nips which are elongated in the web travel direction.

25. The press section in accordance with claim 24, wherein at least one of said first and second press roll is a shoe press roll, and wherein at least one of said third and fourth press roll is a shoe press roll.

26. The press section in accordance with claim 17, wherein said two press belts of at least one of said first and second press are arranged to run separately at least one of entering and exiting a respective one of said at least one first and second nip, and wherein a press belt angle between said two press belts at least one of entering and exiting said at least one first and second nip is greater than approximately 15°.

27. The press section in accordance with claim 17, wherein a first separation angle formed by the separation of said first and second press belts is greater than approximately 15°, and wherein a second separation angle formed by the separation of said third and fourth press belts is greater than approximately 15°.

28. The press section in accordance with claim 27, wherein at least one of said first and second separation angle is greater than approximately 30°.

29. The press section in accordance with claim 28, wherein said first and said second separation angles are greater than approximately 30°.

30. The press section in accordance with claim 17, further comprising air removal devices positioned adjacent at least one of said first, second, third, and fourth press belt to remove an air boundary layer prior to contacting the fiber web.

31. The press section in accordance with claim 30, wherein said air devices comprise at least one of a doctor, a compressed air nozzle, and a suction roll.

32. A process of pressing a fiber web in a press section that includes at least two press nips, each of the at least two press nips being formed by two press rolls, at least one continuously revolving press belt being guided around each press roll, at least one guide region being formed at least one of before and after at least one of the two press nips, and guide elements arranged at an end of each guide region, the process comprising:

successively pressing the fiber web in the at least two press nips;

jointly guiding the fiber web between two of the press belts in the at least one guide region, wherein the at least one guide region comprises a substantially straight path;

separating the two press belts at the guide element at the end of the at least one guide region at a separation angle of at least 15°, wherein the at least one guide region is located after the first press nip in the web travel direction; and adjusting the separation angle at the end of the at least one guide region by moving the guide element.

33. The process in accordance with claim 32, further comprising guiding the fiber through one of the at least one guide regions which exits the second press nip in a web travel direction.

34. The process in accordance with claim 33, further comprising guiding the fiber web through another of the at least one guide regions which enters the second press nip.

35. The process in accordance with claim 34, further comprising guiding the fiber through another of the at least one guide regions which exits the first press nip in the web travel direction.

36. The process in accordance with claim 33, further comprising separating the fiber web from one of the press belts when exiting the first press nip in the web travel direction.

37. The process in accordance with claim 36, wherein a separation angle of the press belt exiting the first nip is greater than 15°.

38. The process in accordance with claim 33, further comprising separating the press belts upon exiting the first press nip in the web travel direction.

39. The process in accordance with claim 32, wherein the guide element is movable in a direction substantially perpendicular to an angle bisector of a looping angle of one of the press belts around the guide element.

40. A press section of a machine for producing a fiber web, comprising:

at least two press nips arranged in succession in a web travel direction, wherein each of said at least two press nips is formed by two press rolls;

at least one continuously revolving press belt being guided around each press roll;

wherein, at least one of before and after at least one of said at least two press nips, a guide region is formed in which two of said press belts are arranged to run jointly along a straight path, and the fiber web is adapted to run between said two press belts along said straight path; and guide elements arranged at an end of each guide region, wherein at an end of each guide region, said press belts are guided over said guide elements to run separately from one another, and wherein a press belt angle between said press belts at said guide elements is greater than approximately 15°, wherein said guide elements comprise rotatable guide rolls having a radius smaller than approximately 0.8 m, wherein at least one of said guide elements is a movably mounted guide roll, and said guide region is at least approximately 0.5 m long.

* * * * *